US009128404B2

(12) United States Patent
Higaki

(10) Patent No.: US 9,128,404 B2
(45) Date of Patent: Sep. 8, 2015

(54) IMAGE FORMATION UNIT AND IMAGE FORMATION APPARATUS

(71) Applicant: Oki Data Corporation, Tokyo (JP)

(72) Inventor: Toshimasa Higaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/102,570

(22) Filed: Dec. 11, 2013

(65) Prior Publication Data

US 2014/0169826 A1 Jun. 19, 2014

(30) Foreign Application Priority Data

Dec. 17, 2012 (JP) ..... 2012-275185

(51) Int. Cl.
*G03G 15/02* (2006.01)
*G03G 21/00* (2006.01)

(52) U.S. Cl.
CPC ..... *G03G 15/0258* (2013.01); *G03G 21/0017* (2013.01)

(58) Field of Classification Search
CPC ..... G03G 15/161; G03G 2215/0132; G03G 21/0035; G03G 2215/1661; G03G 15/0189; G03G 15/0808; G03G 15/1605; G03G 15/162; G03G 15/1675; G03G 15/168; G03G 21/0011; G03G 21/0058; G03G 2215/0129
See application file for complete search history.

(56) References Cited

U.S. PATENT DOCUMENTS

2005/0191081 A1* 9/2005 Muraishi et al. ..... 399/100
2008/0159772 A1* 7/2008 Koishi et al. ..... 399/90

FOREIGN PATENT DOCUMENTS

| | | | |
|---|---|---|---|
| JP | H07-028297 | A | 1/1995 |
| JP | H11-149197 | A | 6/1999 |
| JP | 2006-133373 | A | 5/2006 |
| JP | 2006-184487 | A | 7/2006 |
| JP | 2007-286328 | A | 11/2007 |
| JP | 2008-310056 | A | 12/2008 |
| JP | 2009-282247 | A | 12/2009 |
| JP | 2011-095725 | A | 5/2011 |

* cited by examiner

*Primary Examiner* — Roy Y Yi
(74) *Attorney, Agent, or Firm* — Marvin A. Motsenbocker; Mots Law, PLLC

(57) ABSTRACT

An image formation unit includes a rotatable image carrier, a charge member configured to electrically charge a surface of the image carrier, a charge cleaning member including cell marks in a surface layer thereof and configured to clean a surface of the charge member, a first cleaning member configured to clean the surface of the image carrier, and a second cleaning member including cell marks in a surface layer thereof and provided downstream of the first cleaning member in a rotation direction of the image carrier. The cell density of the charge cleaning member is equal to or more than the cell density of the second cleaning member.

18 Claims, 5 Drawing Sheets

IMAGE FORMATION UNIT AND IMAGE FORMATION APPARATUS

CROSS REFERENCE TO RELATED APPLICATIONS

This application claims priority based on 35 USC 119 from prior Japanese Patent Application No. 2012-275185 filed on Dec. 17, 2012, entitled "IMAGE FORMATION UNIT AND IMAGE FORMATION APPARATUS", the entire contents of which are incorporated herein by reference.

BACKGROUND OF THE INVENTION

1. Field of the Invention

The disclosure relates to an image formation unit and an image formation apparatus which use an electrophotographic process.

2. Description of Related Art

Some conventional image formation units are configured such that a second cleaning member is provided between a first cleaning member and a charge member. The first cleaning member comes into contact with a rotatable image carrier on which a developer image is formed to remove a developer remaining on the image carrier. The charge member comes into contact with the image carrier to electrically charge the image carrier. The second cleaning member recovers adhered substances slipped through the first cleaning member (see, for example, Japanese Patent Application Publication No. 2009-282247).

SUMMARY OF THE INVENTION

However, the image quality may be lowered in the aforementioned conventional technique.

One embodiment of the invention aims to improve the image quality.

An aspect of the invention is an image formation unit including: an image carrier provided in a rotatable manner; a charge member configured to electrically charge a surface of the image carrier; a charge cleaning member including cell marks in a surface layer thereof and configured to clean a surface of the charge member; a first cleaning member configured to clean the surface of the image carrier; and a second cleaning member including cell marks in a surface layer thereof and provided downstream of the first cleaning member in a rotation direction of the image carrier. The cell density of the charge cleaning member is equal to or more than the cell density of the second cleaning member.

Another aspect of the invention is an image formation unit including: an image carrier provided in a rotatable manner; a charge member configured to electrically charge a surface of the image carrier; a charge cleaning member including cell marks in a surface layer thereof and configured to clean a surface of the charge member; a first cleaning member configured to clean the surface of the image carrier; and a second cleaning member including cell marks in a surface layer thereof and provided downstream of the first cleaning member in a rotation direction of the image carrier. The cell density of the charge cleaning member is equal to or more than half the cell density of the second cleaning member.

According to the above aspects, the image quality is improved.

DETAILED DESCRIPTION OF EMBODIMENTS

Figure 1:
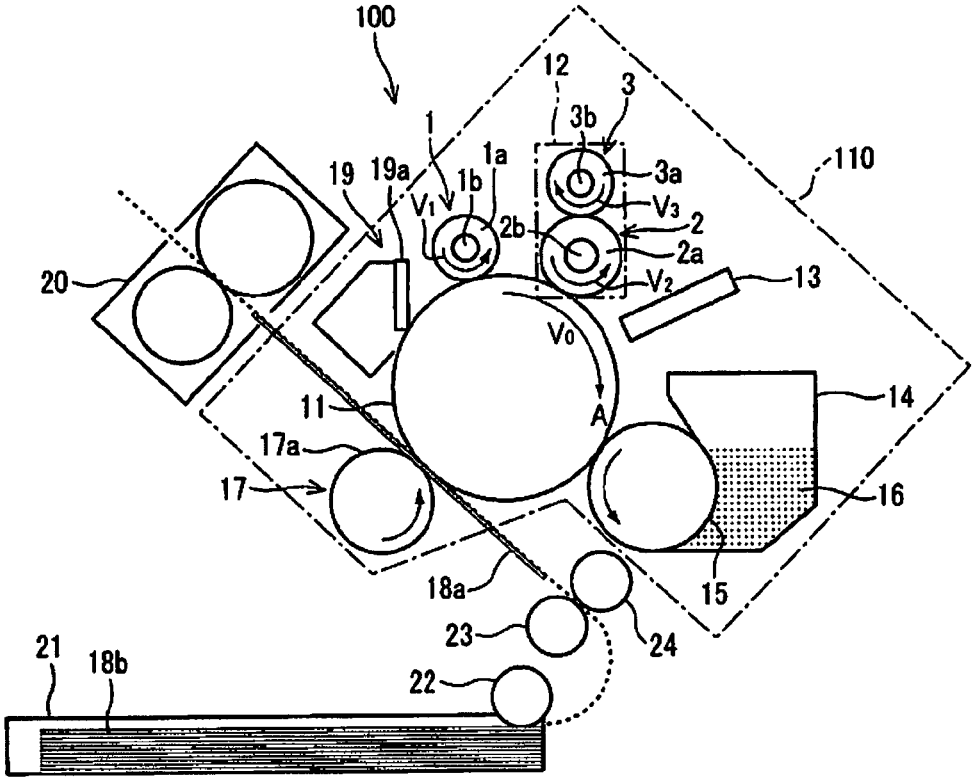
FIG. 1 is a schematic side cross-sectional view illustrating a configuration of an image formation apparatus according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Hereinafter, embodiments of an image formation unit and an image formation apparatus according to the invention are described with reference to the drawings.

First Embodiment

FIG. 1 is a schematic side cross-sectional view illustrating a configuration of an image formation apparatus according to a first embodiment. In FIG. 1, image formation apparatus 100 is provided with an image formation unit which uses an electrophotographic process, and is, for example, a printer, a facsimile device, a copier, a multifunction peripheral, or the like. Image formation apparatus 100 includes: paper supply tray 21 configured to house and hold printing medium 18*b*; conveyance rollers 22, 23, and 24 serving as conveyance members configured to sandwich and convey printing medium 18*b* transferred from paper supply tray 21; image formation unit 110 configured to form a toner image as a developer image on printing medium 18*a*; and fixation device 20 configured to fix the toner image transferred on printing medium 18*a*.

Moreover, image formation unit 110 includes: photosensitive drum 11 serving as a rotatable image carrier; charge device 12 which includes charge roller 2 and charge cleaning roller 3; exposure device 13; development device 14; development roller 15; transfer device 17; cleaning device 19; and drum cleaning roller 1. Photosensitive drum 11 has a rotatable drum shape and rotates in a direction indicated by arrow A in the drawing during printing. Charge device 12, exposure device 13, development device 14, transfer device 17, and cleaning device 19 are disposed around photosensitive drum 11 in this order from an upstream side in the direction indicated by arrow A in the drawing.

Image formation apparatus 100 includes two or more image formation units 110 arranged therein, and toner as developers of different colors is supplied respectively to image formation units 110 to allow multi-color printing. Image formation apparatus 100 having such a configuration is provided with a controller including a central processing unit (CPU) and the like, and a storage unit including a memory and the like. The controller controls an overall operation of image formation apparatus 100 on the basis of a control program (software) stored in the storage unit.

Photosensitive drum 11 is configured to laminate a charge generation layer including a charge generation material and a binder resin as main components, and a charge transport layer including a charge transport material and a binder resin as main components, on a conductive support. In the embodiment, the surface of an aluminum pipe serving as the conductive support is anodized. As for the charge generation layer, phthalocyanine is used as the charge generation material, and a polyvinyl acetal-based resin is used as the binder resin. As for the charge transport layer, a hydrazone-based compound is used as the charge transport material, a polycarbonate-based resin is used as the binder resin, and an antioxidant is added thereto. Moreover, the charge transport layer of the photosensitive drum 11 has a film thickness of 15 μm.

Charge device 12 serving as a charge unit electrically charges the surface of photosensitive drum 11, and is provided with charge roller 2 serving as a rotatable charge member, and charge cleaning roller 3 serving as a rotatable charge cleaning unit for cleaning the surface of charge roller 2. Charge roller 2 is disposed in such a manner as to come into contact with (hereinafter, referred to as "nip") or come close to photosensitive drum 11. Charge roller 2 includes conductive rubber layer 2*a* serving as a conductive elastic layer formed on the surface of metal shaft 2*b* serving as a conductive support, and the surface of conductive rubber layer 2*a* can be subjected to surface treatment or coating if necessary. Further, the conductive support of charge roller 2 is connected with a charge power supply for applying a charge voltage thereto.

As for conductive rubber layer 2*a* of charge roller 2, an elastic body containing rubber, a thermoplastic elastomer, a resin, or the like can be used such that conductive rubber layer 2*a* comes into contact with photosensitive drum 11 to obtain adequate discharge with photosensitive drum 11. Conductive rubber layer 2*a* may be not only a single layer but also may have a multilayer structure of two or more layers if necessary to adjust the resistance, prevent contamination of photosensitive drum 11, and adjust the hardness, and the like. Materials that can be included in conductive rubber layer 2*a* of charge roller 2, are, for example, epichlorohydrin rubber (CO, ECO, GECO), ethylene propylene rubber (EPM, EPDM), nitrile rubber (NBR), chloroprene rubber (CR), urethane rubber, silicone rubber, or the like, or a rubber composition containing one or two or more rubber being mixed as a main component. Among these rubber, epichlorohydrin rubber (ECO) is particularly used as a main component in many cases.

As for conductive characteristics, a predetermined conductivity is applied using ion conductivity rubber, an elastomer, or a resin, an ion conductivity agent, carbon black, a metallic oxide, or the like. Both the electron conductivity and the ion conductivity can be used as the conductivity. The material having an ion conductivity is more often used than the material having an electron conductivity because a partial resistance non-uniformity is likely to affect on the charge non-uniformity of photosensitive drum 11 and the resistance non-uniformity is required to be suppressed.

Figure 2:
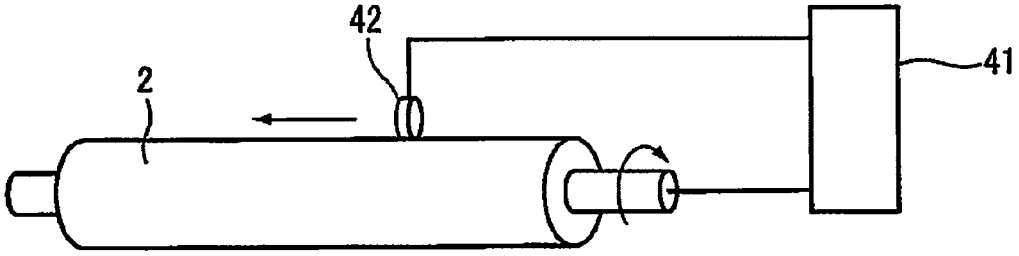
FIG. 2 is an explanation view of the measurement of resistance of a charge roller in the first embodiment.

Moreover, conductive rubber layer 2*a* of charge roller 2 is preferably a resistance layer having a resistance value of $10^6$ to $10^9\Omega$. A method illustrated in FIG. 2 is employed for measurement of the resistance in this case, and a resistance value is measured using a high resistance meter (4339B, manufactured by Agilent Technologies, Inc.) as resistance measurement device 41. The resistance value is measured by bringing bearing 42 made of a SUS (stainless steel) material having a width of 2.0 mm and a diameter of 6.0 mm into contact with charge roller 2 and sliding in the axial direction thereof. The resistance value of charge roller 2 generally varies depending on the temperature, the humidity, or the measurement voltage in many cases. Thus, the resistance value is herein measured in an environment of temperature at 20° C. and in humidity at 50% RH such that a DC voltage of minus 500 V is applied to the side of a core metal of charge roller 2.

The hardness of conductive rubber layer 2*a* of charge roller 2 is adjusted for obtaining an adequate nip with photosensitive drum 11 because a minute gap between the surface of charge roller 2 and the surface of photosensitive drum 11 is required to be formed to secure a region which contributes to the discharge in accordance with Paschen's law. Conductive rubber layer 2*a* of charge roller 2 has an outer surface shape with predetermined polishing marks and a surface roughness formed by cutting and polishing processes. In this case, the surface roughness of charge roller 2 is preferable to have a maximum height Ry (in conformity with: JIS B 0601:1994) within the range of about 1 μm to 40 μm in accordance with Paschen's law although being varied somewhat depending on the voltage to be applied or the use environment.

Here, a polishing method for the outer surface of conductive rubber layer 2*a* of charge roller 2 is described. The polishing method for the outer surface of conductive rubber layer 2*a* of charge roller 2 includes a wet polishing method and a dry polishing method. Examples of the wet polishing method include tape polishing or finisher polishing, and examples of the dry polishing method include grinder polishing or polishing with metal teeth. When the outer surface of conductive rubber layer 2*a* of charge roller 2 is polished by the wet polishing method, in the surface of charge roller 2 illustrated in FIG. 3, grooves are formed extending in the rotation direction of charge roller 2 indicated by an arrow in the drawing; in other words, the vertical grooves 52*a* illustrated in FIG. 4.

Figure 3:
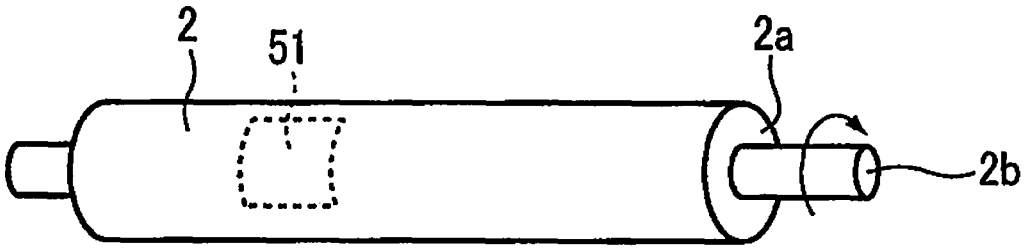
FIG. 3 is an explanation view of the charge roller in the first embodiment.
Figure 4:
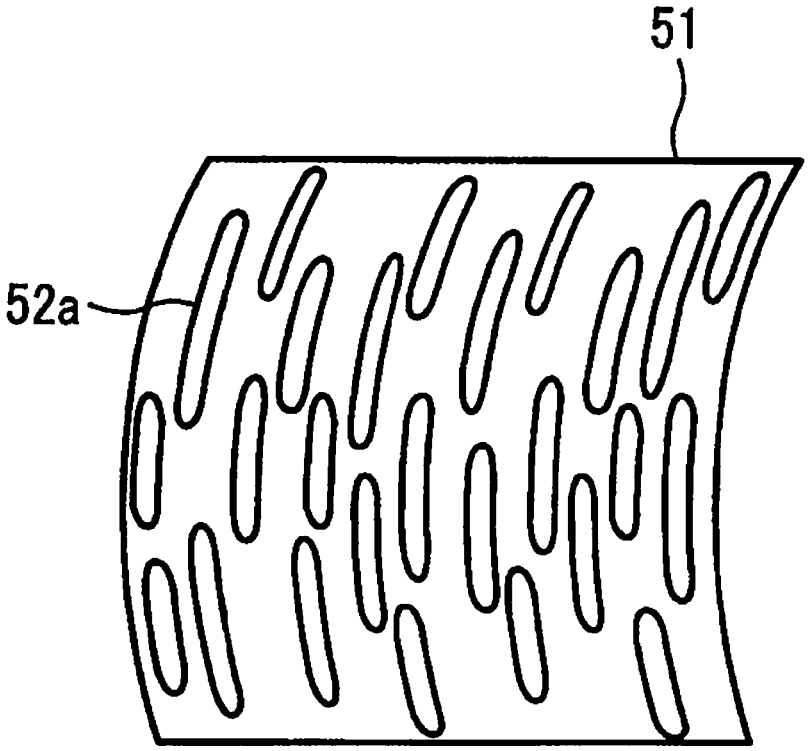
FIG. 4 is an explanation view of the surface of the charge roller in the first embodiment.
Figure 5:
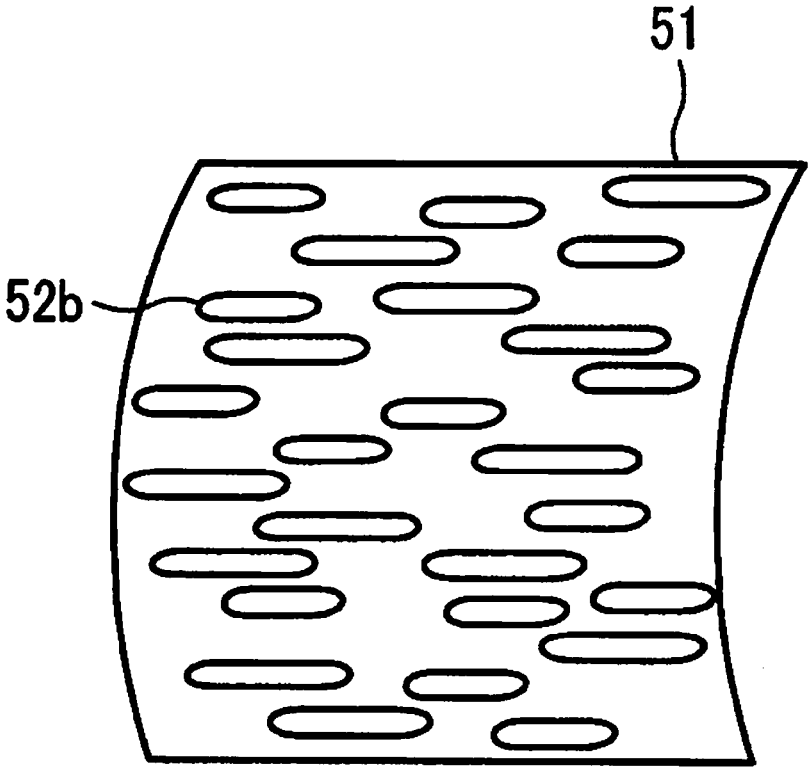
FIG. 5 is an explanation view of the surface of the charge roller according to a second embodiment.

In contrast, when the outer surface of conductive rubber layer 2*a* of charge roller 2 is polished by the dry polishing method, in the surface of charge roller 2 illustrated in FIG. 3, grooves are formed extending in the longitudinal direction of charge roller 2; in other words, the transverse grooves 52*b* illustrated in FIG. 5. Note that, FIG. 4 and FIG. 5 are views of region 51 being enlarged, which is a part of the outer surface of conductive rubber layer 2*a* of charge roller 2 in FIG. 3. The outer surface of conductive rubber layer 2*a* of charge roller 2 can be subjected to surface treatment or coating. The surface treatment or the coating allows contamination of photosensitive drum 11 to be prevented and the resistance of the conductive layer to be adjusted.

As for charge roller 2 in the embodiment, a shaft body made of a metal including a free cutting steel (SUM) is used as the conductive support, and an elastic body including epichlorohydrin rubber as a main component is used as conductive rubber layer 2*a* to which an ion conductivity agent is added to adjust the resistance. Moreover, the outer surface of conductive rubber layer 2*a* for use is subjected to wet polishing, and then is applied with a surface treatment liquid containing an isocyanate compound. Accordingly, vertical grooves 52*a* illustrated in FIG. 4 extending in the rotation direction of charge roller 2 are formed in the outer surface of conductive rubber layer 2*a*. The surface roughness is set to about 10 μm for the maximum height Ry in the axial direction of charge roller 2, and to about 100 μm for an average irregularity interval Sm in the axial direction of charge roller 2. The hardness of the conductive layer is measured using a micro rubber durometer MD-1 capa (Type A) manufactured by KOBUNSHI KEIKI CO., LTD, and is set to 54 degrees.

Charge cleaning roller 3 comes into contact with the surface of conductive rubber layer 2*a* of charge roller 2, and includes foam cells (cells of foam) in a surface layer thereof. Charge cleaning roller 3 includes foam rubber layer 3*a* serving as a foam elastic layer which is an elastic layer provided on the surface of metal shaft 3*b* serving as a support. The foam rubber layer 3*a* includes therein foam cells, which are air bubbles therein. Some of the form cells are exposed to the surface of foam rubber layer 3*a* as grooves on the surface of foam rubber layer 3*a*, and are referred to as cell marks. Charge cleaning roller 3 for use may be conductive or non-conductive. A foam body such as foam rubber, an urethane foam, or a melamine foam can be used as foam rubber layer 3*a* of charge cleaning roller 3.

It is preferred that charge cleaning roller 3 have a linear velocity (circumferential speed) at the surface of charge cleaning roller 3 that is almost equivalent to the circumferential speed of charge roller 2. As for charge cleaning roller 3 in the embodiment, a shaft body made of a metal including free cutting steel (SUM) is used as the support, and an urethane foam is used for the elastic layer to be rotated at a predetermined circumferential speed ratio with respect to charge roller 2. In the embodiment, when the linear velocity of charge roller 2 is set to $V_2$ and the linear velocity of charge cleaning roller 3 is set to $V_2$, $V_3=0.95\times V_2$ is obtained. The preferable linear velocity ratio (circumferential speed ratio) is 0.8 to 1.2. The reason why the linear velocity ratio is limited in this manner is because the larger linear velocity ratio might cause charge cleaning roller 3 to damage the surface of charge roller 2.

Exposure device 13 serving as an exposure unit is provided with a light source configured to emit light corresponding to image information onto the surface of photosensitive drum 11. In the embodiment, a light emitting diode (LED) head is used as exposure device 13. Exposure device 13 emits light corresponding to image information onto the surface of photosensitive drum 11 to be exposed so that the charge potential in the exposed portion is reduced, thereby forming an electrostatic latent image on the surface of photosensitive drum 11.

Development device 14 serving as a development unit develops the electrostatic latent image formed on the surface of photosensitive drum 11 with a developer, and is provided with development roller 15. Development roller 15 is disposed in such a manner as to come close to or come into sliding contact with photosensitive drum 11. Inside development device 14, toner 16 serving as a developer is provided. Development roller 15 is uniformly applied with toner 16 on the surface thereof to form a toner layer thereon. Development roller 15 with the toner layer formed on the surface thereof comes close to, or come into sliding contact with. photosensitive drum 11. Development roller 15 includes a conductive layer having a conductivity formed on a conductive support, and the surface of the conductive layer can be subjected to surface treatment or coating if necessary. Moreover, the conductive support of development roller 15 is connected with a development power supply for applying a development voltage thereto.

In the embodiment, a shaft body made of a metal including free cutting steel (SUM) is used as the conductive support, and urethane rubber as a main component is used for the conductive layer to which carbon black serving as an electron conductivity agent (Ketjen Black) is added to adjust the resistance. The outer surface of the elastic layer for use is applied with a surface treatment liquid containing an isocyanate compound carbon black (acetylene black). Toner obtained by mixing an external additive into toner particles serving as a base can be used as toner 16 serving as a developer in development device 14.

In the embodiment, non-magnetic one-component negatively charged polymerization toner is used. The toner for use is obtained such that fine powders of silica and titanium oxide serving as external additives are added to and mixed into toner particles generated such that a styrene acrylic copolymer resin manufactured by an emulsion polymerization method, a coloring agent and a wax are mixed and aggregated. The toner particle for use has a degree of circularity of about 0.94 to 0.98 and a particle diameter of about 5.5 to 7.0 μm. The external additive for used has a particle diameter of 50 to 200 nm. Development device 14 conveys toner to the electrostatic latent image formed on the surface of photosensitive drum 11 by exposure device 13 to form a toner image. In this case, a development bias voltage is applied to development roller 15 from the development power supply. In the embodiment, the development bias voltage for use is DC −250 V.

Transfer device 17 serving as a transfer unit transfers the toner developed on the surface of photosensitive drum 11 onto printing medium 18*a*, and is provided with transfer roller 17*a*. Transfer roller 17*a* is disposed in such a manner as to come into contact with photosensitive drum 11. Transfer roller 17*a* includes a conductive elastic layer formed on a conductive support. The conductive support of transfer roller 17*a* is connected with a transfer power supply for applying a transfer voltage thereto. Moreover, transfer device 17 may be provided with a cleaning member for cleaning transfer roller 17*a* serving as a transfer member if necessary.

In the embodiment, a shaft body made of a metal including free cutting steel (SUM) is used as the conductive support of transfer roller 17*a*, and a rubber foam body is used as the conductive elastic layer into which epichlorohydrin rubber and acrylonitrile-butadiene rubber as main components are mixed to adjust the resistance in accordance with the mixture ratio of the epichlorohydrin rubber. The rubber foam body for use has a foam cell diameter of 50 to 300 μm and a rubber hardness of about 35 degrees in terms of Asker C. Transfer device 17 with such a configuration transfers the toner imaged formed on the surface of photosensitive drum 11 onto printing medium 18*a*.

Cleaning device 19 serves as a first cleaning unit or a first cleaning member and is provided with cleaning blade 19*a* which removes toner remaining on the surface of photosensitive drum 11 without being transferred by transfer device 17. Cleaning blade 19*a* includes a blade member of an elastic body fixed to a support and is disposed such that an edge portion of the blade member comes into sliding contact with photosensitive drum 11. As for cleaning device 19 in the embodiment, an SECC (electro-galvanized steel sheet) is used for the support, and a polyurethane member is used for cleaning blade 19*a*. Cleaning device 19 scrapes off toner 16 on photosensitive drum 11 without being transferred by transfer device 17 onto printing medium 18*a* by the edge portion of cleaning blade 19*a*.

Although cleaning device 19 can scrape off toner particles of toner 16 remaining on photosensitive drum 11 in this manner, a part of the external additives slips through cleaning device 19 and remains adhered on photosensitive drum 11. The amount of the external additives slipped through cleaning device 19 varies depending on the type of toner 16, cleaning blade 19*a*, photosensitive drum 11, the environment in terms of temperature and humidity, or the like, and also varies depending on whether or not the surface of photosensitive drum 11 is a portion on which the toner image is formed. In general, the ratio of the area of fine particles of the external additives covering the surface of photosensitive drum 11 with respect to the total surface area of photosensitive drum 11 is preferably 5% or less, and the smaller ratio, 3% or less, is more preferable. In the embodiment, the ratio of the area of the external additives covering the surface of photosensitive drum 11 with respect to the total surface area of photosensitive drum 11 is set to about 3% on average.

Drum cleaning roller 1, serving as a second cleaning unit or a second cleaning member, uniformly scatters the external additives in the toner remaining on the surface of photosensitive drum 11 without being removed by cleaning device 19, and is a rotatable member including foam cells (cells of foam) in a surface layer thereof. Drum cleaning roller 1 includes foam rubber layer 1*a* serving as a foam elastic layer which is an elastic layer provided on the surface of metal shaft 1*b* serving as a support. The foam rubber layer 1*a* includes therein foam cells, which are air bubbles therein. Some of the foam cells are exposed to the surface of foam rubber layer 1*a* as grooves on the surface of foam rubber layer 1*a*, and are referred to as cell marks. Moreover, drum cleaning roller 1 for use may be conductive or non-conductive.

A foam body such as foam rubber, an urethane foam, or a melamine foam can be used as foam rubber layer 1*a* of drum cleaning roller 1. A nip state between drum cleaning roller 1 and photosensitive drum 11 is required to equally come into contact with each other in the longitudinal direction of photosensitive drum 11, different from a nip state between charge roller 2 and charge cleaning roller 3. Further, drum cleaning roller 1 may be driven due to contact with photosensitive drum 11, or the circumferential speed ratio may be set. As for drum cleaning roller 1 in the embodiment, a shaft body made of a metal including free cutting steel (SUM) is used as the support, and an urethane foam is used for the elastic layer. Drum cleaning roller 1 is rotated at a predetermined circumferential speed ratio with respect to photosensitive drum 11.

In the embodiment, when the linear velocity of photosensitive drum 11 is set to $V_0$ and the linear velocity of drum cleaning roller 1 is set to $V_1$, $V_1=0.95\times V_0$ is obtained. The preferable linear velocity ratio (circumferential speed ratio) is 0.8 to 0.98 or 1.02 to 1.2. The linear velocity ratio is set within such a range in order that drum cleaning roller 1 may distribute or apply the external additives adhered on photosensitive drum 11 onto photosensitive drum 11. Meanwhile, the larger linear velocity ratio might cause drum cleaning roller 1 to damage the surface of photosensitive drum 11 or cause a film reduction of the photoconductive layer to be generated.

Drum cleaning roller 1 recovers or scatters the external additives slipped through cleaning device 19, and again applies the recovered external additive to the surface of photosensitive drum 11 to uniform the external additives adhered on the surface of photosensitive drum 11 per unit area. Fixation device 20 fixes the toner image transferred on printing medium 18*a* to printing medium 18*a* by being heated and pressed. In the embodiment, the density of the foam cells of drum cleaning roller 1 described above is set to 25, 50, and 100 (pieces/25 mm) and the density of the foam cells of charge cleaning roller 3 is set to 25, 50, and 100 (pieces/25 mm). The following six types of combinations (Nos. 1 to 6) are obtained in combination with the respective values of the density.

<No. 1> An ether-based urethane foam having a density of the foam cells of about 25 (pieces/25 mm) and a hardness of the sponge of Asker F30 degrees or less is used for foam rubber layer 1*a* of drum cleaning roller 1. An ether-based urethane foam having a density of the foam cells of about 25 (pieces/25 mm) and a hardness of the sponge of Asker F30 degrees or less is used for foam rubber layer 3*a* of charge cleaning roller 3.

<No. 2> An ether-based urethane foam having a density of the foam cells of about 50 (pieces/25 mm) and a hardness of the sponge of Asker F30 degrees or less is used for foam rubber layer 1*a* of drum cleaning roller 1. An ether-based urethane foam having a density of the foam cells of about 50 (pieces/25 mm) and a hardness of the sponge of Asker F30 degrees or less is used for foam rubber layer 3*a* of charge cleaning roller 3.

<No. 3> An ether-based urethane foam having a density of the foam cells of about 100 (pieces/25 mm) and a hardness of the sponge of Asker F30 degrees or less is used for foam rubber layer 1*a* of drum cleaning roller 1. An ether-based urethane foam having a density of the foam cells of about 100 (pieces/25 mm) and a hardness of the sponge of Asker F30 degrees or less is used for foam rubber layer 3*a* of charge cleaning roller 3.

<No. 4> An ether-based urethane foam having a density of the foam cells of about 25 (pieces/25 mm) and a hardness of the sponge of Asker F30 degrees or less is used for foam rubber layer la of drum cleaning roller 1. An ether-based urethane foam having a density of the foam cells of about 50 (pieces/25 mm) and a hardness of the sponge of Asker F30 degrees or less is used for foam rubber layer 3*a* of charge cleaning roller 3.

<No. 5> An ether-based urethane foam having a density of the foam cells of about 25 (pieces/25 mm) and a hardness of the sponge of Asker F30 degrees or less is used for foam rubber layer 1*a* of drum cleaning roller 1. An ether-based urethane foam having a density of the foam cells of about 100 (pieces/25 mm) and a hardness of the sponge of Asker F30 degrees or less is used for foam rubber layer 3*a* of charge cleaning roller 3.

<No. 6> An ether-based urethane foam having a density of the foam cells of about 50 (pieces/25 mm) and a hardness of the sponge of Asker F30 degrees or less is used for foam rubber layer 1*a* of drum cleaning roller 1. An ether-based urethane foam having a density of the foam cells of about 100 (pieces/25 mm) and a hardness of the sponge of Asker F30 degrees or less is used for foam rubber layer 3*a* of charge cleaning roller 3. Moreover, the following three types (Comparative Examples 1 to 3) of combinations of the density of the foam cells of drum cleaning roller 1 and the density of the foam cells of charge cleaning roller 3 are employed as Comparative Examples.

Comparative Example 1

An ether-based urethane foam having a density of the foam cells of about 50 (pieces/25 mm) and a hardness of the sponge of Asker F30 degrees or less is used for foam rubber layer 1*a* of drum cleaning roller 1. An ether-based urethane foam having a density of the foam cells of about 25 (pieces/25 mm) and a hardness of the sponge of Asker F30 degrees or less is used for foam rubber layer 3*a* of charge cleaning roller 3.

Comparative Example 2

An ether-based urethane foam having a density of the foam cells of about 100 (pieces/25 mm) and a hardness of the sponge of Asker F30 degrees or less is used for foam rubber layer 1*a* of drum cleaning roller 1. An ether-based urethane foam having a density of the foam cells of about 25 (pieces/25 mm) and a hardness of the sponge of Asker F30 degrees or less is used for foam rubber layer 3*a* of charge cleaning roller 3.

Comparative Example 3

An ether-based urethane foam having a density of the foam cells of about 100 (pieces/25 mm) and a hardness of the sponge of Asker F30 degrees or less is used for foam rubber layer 1*a* of drum cleaning roller 1. An ether-based urethane foam having a density of the foam cells of about 50 (pieces/25 mm) and a hardness of the sponge of Asker F30 degrees or less is used for foam rubber layer 3*a* of charge cleaning roller 3.

The effect of the configurations described above is described. Firstly, an operation of the image formation apparatus is described on the basis of FIG. 1. Upon receiving a signal instructing a printing operation from a higher-level apparatus or the like, a controller in image formation apparatus 100 starts a printing operation, and converts the received signal into image information. Photosensitive drum 11 rotates in a direction indicated by arrow A in the drawing, and the surface thereof is uniformly electrically charged at a predetermined potential by charge device 12. Photosensitive drum 11 thus electrically charged is irradiated with light in accordance with the signal of the image information by exposure device 13 so that an electrostatic latent image is formed on the surface thereof. Development device 14 adheres toner 16 on the electrostatic latent image formed on the surface of photosensitive drum 11 so that a toner image is formed.

Transfer device 17 transfers the toner image formed on the surface of photosensitive drum 11 from photosensitive drum 11 to printing medium 18*a*. Printing medium 18*a*, onto which the toner image is transferred, passes through fixation device 20 while the toner image is fixed thereto, and is transferred outside image formation apparatus 100. Meanwhile, when photosensitive drum. 11 passes through transfer device 17 to reach cleaning device 19, cleaning device 19 scrapes off the toner which is not transferred but remains on the surface of photosensitive drum 11.

In cleaning device 19, although the toner particles remaining on the surface of photosensitive drum 11 are uniformly recovered, some external additives are recovered and some external additives slip through cleaning device 19. The external additives that slipped through cleaning device 19 are recovered or scattered by drum cleaning roller 1. The surface of photosensitive drum 11 passed through drum cleaning roller 1 is again uniformly electrically charged by charge device 12. The operation described above is repeated until the printing operation is completed.

In the embodiment, evaluation tests are performed for drum cleaning roller 1 and charge cleaning roller 3 for six types of combinations (Nos. 1 to 6) and drum cleaning roller 1 and charge cleaning roller 3 in Comparative Example 1 to Comparative Example 3, in which the density of the foam cells of drum cleaning roller 1 is set to 25, 50, and 100 (pieces/25 mm) and the density of the foam cells of charge cleaning roller 3 is set to 25, 50, and 100 (pieces/25 mm).

These evaluation tests are performed such that sheets of A4 paper are continuous printed, an evaluation image is printed every time when 10000 sheets of paper with a printing pattern having a 5% coverage printing area (the ratio of the area to be printed with respect to the total area capable of being printed) are printed, and the evaluation images are evaluated until 60000 sheets of paper with a printing pattern having a 5% coverage printing area are printed. Moreover, these evaluation tests are performed under the temperature/humidity environment at 23±3° C. (temperature) an at 50±15% RH (humidity).

The evaluation image includes two types of printing patterns of a 2by2 halftone image in 600 dpi (dots per inch) and a printing pattern having a 0% coverage printing area. Note that, the 2by2 halftone image is an image formed by printing dots of 4 squares formed by 2 dots in the vertical direction and 2 dots in the transverse direction, among 16 squares formed by 4 dots in the vertical direction and 4 dots in the transverse direction. The evaluation reference is set with respect to the two types of evaluation images in such a manner that "poor" is assigned when generation of an image dust, a vertical streak, and a vertical band is visually confirmed, and "good" is assigned when there is no generation.

Here, the image dust is a black point formed on the evaluation image because a massive external additive is adhered on charge roller 2 to cause spotted charge failure to be generated on photosensitive drum 11. The vertical streak is a black streak formed on the evaluation image because a ring-shaped (rotation direction of charge roller 2) external additive is adhered on charge roller 2 to cause streaked charge failure to be generated on photosensitive drum 11. The vertical band is the black streak of a band shape having a wider width. Moreover, the resistance of charge roller 2 after the continuous printing is measured. Resistance values before the start of the continuous printing and after the completion of the continuous printing are compared. "Poor" is assigned when the change of the resistance values is twice or more and "good" is assigned when the change is less than twice. Table 1 indicates the evaluation results by the abovementioned evaluation tests.

TABLE 1

| | No. 1 | No. 2 | No. 3 | No. 4 | No. 5 | No. 6 | Comparative Example 1 | Comparative Example 2 | Comparative Example 3 |
|---|---|---|---|---|---|---|---|---|---|
| cell density of drum cleaning roller (pieces/25 mm) | 25 | 50 | 100 | 25 | 25 | 50 | 50 | 100 | 100 |
| cell density of charge cleaning roller (pieces/25 mm) | 25 | 50 | 100 | 50 | 100 | 100 | 25 | 25 | 50 |
| image evaluation result | good | good | good | good | good | good | poor | poor | poor |
| resistance raise of charge roller | 1.9 times | 1.6 times | 1.4 times | 1.8 times | 1.5 times | 1.4 times | 2.7 times | 2.3 times | 2.1 times |
| | good | good | good | good | good | good | poor | poor | poor |

In this manner, preferable evaluation results are obtained in the image evaluation and the evaluation in resistance rise of the charge roller when the cell density of drum cleaning roller 1 is set equal to or less than the cell density of charge cleaning roller 3; in other words, when the foam cell density of charge cleaning roller 3 is set equal to or more than the foam cell density of drum cleaning roller 1. In contrast, evaluation results are poor in Comparative Example 1 to Comparative Example 3 in which the cell density of drum cleaning roller 1 is set to more than the cell density of charge cleaning roller 3 because smudges of the image dust (black dust) corresponding to the rotation cycle of charge roller 2 are generated in the evaluation images.

The reason for this is considered as follows: in a case where a part of the external additives once recovered by drum cleaning roller 1 is aggregated in the foam cells of drum cleaning roller 1, the aggregated external additives as a mass are applied to photosensitive drum 11, and the applied mass of the external additives may be adhered on charge roller 2. The mass of the external additives is in a state being pressed against the surface of charge roller 2 without being cleaned by charge cleaning roller 3, whereby the external additives become incapable of being removed. Moreover, in Comparative Example 1 to Comparative Example 3, the resistance value of charge roller 2 after the completion of the continuous printing is twice or more than the resistance value of charge roller 2 before the start of the continuous printing. This indicates that the external additives that adhered on the surface of charge roller 2 cannot be removed because the resistance value is raised due to the external additives that adhered on the surface of charge roller 2.

As described the above, in the first embodiment, when a wet polished charge roller is used, even if an external additive discharged from a drum cleaning roller adheres on the charge roller, the charge cleaning roller can remove the external additive by setting the foam cell density of the charge cleaning roller equal to or more than the foam cell density of the drum cleaning roller. Therefore, an effect is obtained that gives the ability to suppress the generation of a failure of an image corresponding to the rotation cycle of the charge roller due to the charge failure of the photosensitive drum.

Meanwhile, a failure of an image due to the charge failure of the image carrier might be generated in the image formation apparatus according to Japanese Patent Application Publication No. 2009-282247 because if the second cleaning member insufficiently recovers adhered substances, the adhered substances adhere on the charge member.

Second Embodiment

In a second embodiment, an image formation apparatus provided with a charge roller obtained by a dry polishing method is used. The configuration of the image formation apparatus in the second embodiment is the same as image formation apparatus 100 illustrated in FIG. 1 in the first embodiment, except for the polishing method of the charge roller. Note that, the same reference numerals are given to the same portions as those in the first embodiment described above, and explanations thereof are omitted. As for charge roller 2 illustrated in FIG. 1 in the embodiment, a shaft body made of a metal including free cutting steel (SUM) is used as a conductive support, and an elastic body including epichlorohydrin rubber as a main component is used as conductive rubber layer 2*a* to which an ion conductivity agent is added to adjust the resistance.

Moreover, the outer surface of conductive rubber layer 2*a* for use is subjected to dry polishing, and then is applied with a surface treatment liquid containing an isocyanate compound. Accordingly, transverse grooves 52*b* illustrated in FIG. 5 extending in the longitudinal direction of charge roller 2 are formed in the outer surface of conductive rubber layer 2*a*. The surface roughness is set to about 10 μm for the maximum height Ry in the axial direction of charge roller 2, and about 150 μm for the average irregularity interval Sm in the rotation direction of charge roller 2. The hardness of the conductive layer is measured using a micro rubber durometer MD-1 capa (Type A) manufactured by KOBUNSHI KEIKI CO., LTD, and is set to 54 degrees.

Also in the embodiment similar to the first embodiment, the density of the foam cells of drum cleaning roller 1 is set to 25, 50, and 100 (pieces/25 mm) and the density of the foam cells of charge cleaning roller 3 is set to 25, 50, and 100 (pieces/25 mm). The following six types of combinations (Nos. 1 to 6) are obtained in combination with the respective values of the density. Moreover, the following three types (Comparative Examples 1 to 3) of combinations of the density of the foam cells of drum cleaning roller 1 and the density of the foam cells of charge cleaning roller 3 are employed as Comparative Examples similar to the first embodiment.

The effect of the configurations described above is described. Also in the embodiment similar to the first embodiment, evaluation tests are performed for drum cleaning roller 1 and charge cleaning roller 3 for six types of combinations (Nos. 1 to 6) and drum cleaning roller 1 and charge cleaning roller 3 in Comparative Example 1 to Comparative Example 3, in which the density of the foam cells of drum cleaning roller 1 is set to 25, 50, and 100 (pieces/25 mm) and the density of the foam cells of charge cleaning roller 3 is set to 25, 50, and 100 (pieces/25 mm). Table 2 indicates evaluation results by the abovementioned evaluation tests.

TABLE 2

| | No. 1 | No. 2 | No. 3 | No. 4 | No. 5 | No. 6 | Comparative Example 1 | Comparative Example 2 | Comparative Example 3 |
|---|---|---|---|---|---|---|---|---|---|
| cell density of drum cleaning roller (pieces/25 mm) | 25 | 50 | 100 | 25 | 25 | 50 | 50 | 100 | 100 |
| cell density of charge cleaning roller (pieces/25 mm) | 25 | 50 | 100 | 50 | 100 | 100 | 25 | 25 | 50 |
| image evaluation result | good | good | good | good | good | good | good | good | good |
| resistance raise of charge roller | 1.6 times | 1.4 times | 1.3 times | 1.6 times | 1.4 times | 1.3 times | 1.9 times | 2.1 times | 1.8 times |
| | good | good | good | good | good | good | good | poor | good |

In this manner, the cell density of drum cleaning roller 1 is set to equal to or less than twice the cell density of charge cleaning roller 3 in comparison with the cell density of charge cleaning roller 3; in other words, the foam cell density of charge cleaning roller 3 is set to equal to or more than half of the foam cell density of drum cleaning roller 1. Thus, preferable evaluation results of the evaluation images are obtained in Comparative Example 1 and Comparative Example 3, different from the evaluation results in the first embodiment, and the resistance rise of charge roller 2 is equal to or less than twice, thereby obtaining preferable results.

The reason for this is considered as follows: vertical grooves 52*a* illustrated in FIG. 4 extending in the rotation direction of charge roller 2 are formed in the outer surface of conductive rubber layer 2*a* of charge roller 2 formed by the wet polishing in the first embodiment, and therefore the external additives entered in vertical grooves 52*a* are difficult to be removed; whereas transverse grooves 52*b* illustrated in FIG. 5 extending in the longitudinal direction of charge roller 2 are formed in the outer surface of conductive rubber layer 2*a* of charge roller 2 formed by the dry polishing in the second embodiment, and therefore the external additives entered in transverse grooves 52*b* are easy to be removed. Further, in Comparative Example 2 in which the cell density of drum cleaning roller 1 is set equal to or less than one-fourth of the cell density of charge cleaning roller 3 in comparison, although the evaluation results of the evaluation images up to 60000 sheets of paper are preferable, the resistance rise of the charge roller is poor because the resistance rise is twice or more, which is better than that of the first embodiment.

As described above, in the second embodiment, when a dry polished charge roller is used, even if an external additive discharged from a drum cleaning roller adheres on the charge roller, the charge cleaning roller can remove the external additive by setting the foam cell density of the charge cleaning roller at half of or more than the foam cell density of the drum cleaning roller. Therefore, an effect is obtained that gives the ability to suppress the generation of a failure of an image corresponding to the rotation cycle of the charge roller due to the charge failure of the photosensitive drum.

Note that, the image formation apparatuses described in the first embodiment and the second embodiment can be devices using electrophotographic processes such as a printer, a facsimile device, a copying machine, and a multifunction peripheral (MFP). The image formation units can be image formation units included in those image formation apparatuses.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image formation unit comprising:

an image carrier provided in a rotatable manner;

a charge member configured to electrically charge a surface of the image carrier;

a charge cleaning member including cell marks in a surface layer thereof and configured to clean a surface of the charge member;

a first cleaning member configured to clean the surface of the image carrier; and a second cleaning member including cell marks in a surface layer thereof and provided downstream of the first cleaning member in a rotation direction of the image carrier, wherein the cell density of the charge cleaning member is equal to or more than the cell density of the second cleaning member.

2. The image formation unit according to claim 1, wherein the charge cleaning member includes a support and a foam elastic layer, the cell marks being formed on the foam elastic layer.

3. The image formation unit according to claim 2, wherein the charge cleaning member is provided to be rotatable about the support as a rotation shaft.

4. The image formation unit according to claim 1, wherein the charge member includes a support and a conductive elastic layer.

5. The image formation unit according to claim 4, wherein the charge member is provided to be rotatable about the support as a rotation shaft.

6. The image formation unit according to claim 5, wherein the conductive elastic layer includes grooves formed on a surface thereof, the grooves extending in the rotation direction.

7. The image formation unit according to claim 5, wherein the conductive elastic layer includes grooves formed on a surface thereof, the grooves being along a direction in which the support extends.

8. The image formation unit according to claim 5, wherein the cell density of the charge cleaning member is equal to or more than half the cell density of the second cleaning member.

9. The image formation unit according to claim 1, wherein the second cleaning member includes a support and a foam elastic layer, the cell marks being formed on the foam elastic layer.

10. The image formation unit according to claim 9, wherein the second cleaning member is provided to be rotatable about the support as a rotation shaft.

11. The image formation unit according to claim 10, wherein the linear velocity ratio between the second cleaning member and the image carrier is $V_1=\alpha\times V_0$, where $V_1$ is the linear velocity of the image carrier, $V_0$ is the linear velocity of the second cleaning member, and $\alpha$ is 1.0 2 to 1.2.

12. The image formation unit according to claim 5, wherein the linear velocity ratio between the charge cleaning member and the charge member is $V_3=\beta\times V_2$, where $V_3$ is the linear velocity of the charge cleaning member, $V_2$ is the linear velocity of the charge member, and $\beta$ is 0.8 to 1.2.

13. An image formation apparatus including the image formation unit according to claim 1.

14. The image formation unit according to claim 1, wherein the cell density of the charge cleaning member is more than the cell density of the second cleaning member.

15. An image formation unit comprising:

an image carrier provided in a rotatable manner;

a charge member configured to electrically charge a surface of the image carrier;

a charge cleaning member including cell marks in a surface layer thereof and configured to clean a surface of the charge member;

a first cleaning member configured to clean the surface of the image carrier; and a second cleaning member including cell marks in a surface layer thereof and provided downstream of the first cleaning member in a rotation direction of the image carrier.

16. An image formation unit comprising:

an image carrier provided in a rotatable manner;

a charge member configured to electrically charge a surface of the image carrier;

a charge cleaning member configured to clean a surface of the charge member;

a cleaning blade configured to clean the surface of the image carrier; and a cleaning roller provided downstream of the cleaning blade in a rotation direction of the image carrier

17. The image formation unit according to claim 16, wherein the cleaning roller includes a foam elastic layer constituting the surface thereof.

18. The image formation unit according to claim 16, wherein the cleaning roller is provided to scatter matter attached on the image carrier that have passed through between the cleaning blade and the image carrier.

* * * * *